United States Patent [19]

Ravindram et al.

[11] Patent Number: 4,511,362

[45] Date of Patent: Apr. 16, 1985

[54] FLUIDIZED BED DESULFURIZATION

[75] Inventors: Maddury Ravindram, Duarte; John J. Kalvinskas, South Pasadena, both of Calif.

[73] Assignee: The United States of America as represented by the Administrator of the National Aeronautics and Space Administration, Washington, D.C.

[21] Appl. No.: 526,768

[22] Filed: Aug. 26, 1983

[51] Int. Cl.[3] ..... C10L 9/02

[52] U.S. Cl. ..... 44/1 SR; 201/17

[58] Field of Search ..... 44/1 SR; 201/17

[56] References Cited

U.S. PATENT DOCUMENTS

| | | | |
|---|---|---|---|
| 2,726,148 | 12/1955 | McKinley et al. | 44/1 R |
| 3,130,133 | 4/1964 | Loevenstein | 201/17 |
| 3,759,673 | 9/1973 | Whitten et al. | 44/1 SR |
| 3,878,051 | 4/1975 | Long et al. | 201/17 |
| 4,081,250 | 3/1978 | Hsu et al. | 44/1 R |
| 4,118,200 | 10/1978 | Kruesi | 44/1.00 R |
| 4,325,707 | 4/1982 | Kalvinskas et al. | 44/1.0 SR |
| 4,334,888 | 6/1982 | Corcoran et al. | 44/1.0 SR |
| 4,384,536 | 5/1983 | Biswas | 44/1 SR |
| 4,391,609 | 7/1983 | Kalvinskas et al. | 44/1 SR |

OTHER PUBLICATIONS

Coal Desulfurization by Low Temperature Chlorinolysis Phase II by Kalvinskas et al., JPL Publication 80-15, CIT, Pasadena, CA, Jan. 15, 1980.

*Primary Examiner*—Carl F. Dees

*Attorney, Agent, or Firm*—Paul F. McCaul; John R. Manning; Thomas H. Jones

[57] ABSTRACT

High sulfur content carbonaceous material, such as coal is desulfurized by continuous fluidized suspension (20) in a reactor (18) with chlorine gas, inert dechlorinating gas and hydrogen gas. A source of chlorine gas (30), a source (32) of inert gas and a source (34) of hydrogen gas are connected to the bottom inlet (24) through a manifold (28) and a heater (26). A flow controller (42) operates servos (36, 38, 40) in a manner to continuously and sequentially suspend coal in the three gases. The sulfur content is reduced at least 50% by the treatment.

11 Claims, 4 Drawing Figures

FLUIDIZED BED DESULFURIZATION

ORIGIN OF THE INVENTION

The invention described herein was made in the performance of work under a NASA contract and is subject to the provisions of Section 305 of the National Aeronautics and Space Act of 1958, Public Law 83-568 (72 Stat 435; 42 USC 2457).

TECHNICAL FIELD

The present invention relates to desulfurization of carbonaceous materials and, more particularly, the present invention relates to sulfur removal from coal by reactive treatment of coal in a fluidized bed.

BACKGROUND ART

The ever increasing demand for energy, uncertainties associated with resources of petroleum and natural gas, inherent problems with nuclear power plants and current unfavourable economics of solar energy and biomass utilization have been primary contributory factors for the renaissance of coal as a sustainable energy resource for the next decade and beyond.

The U.S. reserve of coal is about 3 trillion tons. Although the most abundant (80%) fossil fuel in America is coal, the consumption pattern in the United States of America is quite a reversal of form in terms of utilization, with coal representing only 17% and oil and gas about 78%.

The demand for all fossil fuels combined is expected to double by the year 2000, even with increasing the use of nuclear power. While the domestic supply of crude oil and natural gas is not likely to keep pace with the energy demand, coal can play an important role in filling such a gap, and thus reduce the requirements for imported supplies of oil and gas. If this vast coal reserve can be converted to clean fuel, it can supply most of the energy needs of the United States for the next three centuries. Petroleum and natural gas would be utilized for other essential uses, especially as a fuel stock for the synthetic, organic chemical, resin and rubber industries.

However, utilization of coal for power generation and process heat is beset with environmental problems. The major problem with coal combustion units is that associated with sulfur dioxide emissions, although emissions of nitrogen oxides, particulates and trace elements also contribute to environmental degradation. In the last decade several alternatives for controlling sulfur dioxide emissions from coal combustion units have been proposed. These can be broadly classified as:

A. Use of low sulfur content coals.

B. Pre-combustion physical and chemical coal cleaning.

C. Retention of sulfur in the ash during combustion.

D. Post-combustion flue-gas cleanup.

Reserves of coal which contain sufficiently low concentrations of sulfur to enable them to meet the present emission standard of 1.2 lb. $SO_2/10^6$ Btu (which corresponds to 0.7 wt. % sulfur in coal with a heating value of 12,000 Btu/lb.) are both limited and restricted to specific geographical locations. In fact, only 12.3% of U.S. coal reserves are within this compliance level. The major recoverable fractions of Eastern and Midwestern coals contain more than 2 wt. % sulfur.

Sulfur in coal exists primarily in two forms—inorganic and organic in almost equal proportions. The average sulfur content in coals generally varies from 0.5–7% depending on the source and location. The major constituent of inorganic sulfur is iron sulfide, $FeS_2$, commonly known as pyrite. The other forms of inorganic sulfur in coal are sulfate sulfur and elemental sulfur which are normally present in very low concentrations. The low concentration of sulfate sulfur together with its solubility in water make it of little consequence during coal cleaning. The concentration of elemental sulfur in coal is also very small. Pyrite in general is believed to be present as a discrete phase in coal, which incidentally facilitates its removal by float-sink methods. However, with very fine particles even complete pyritic sulfur removal is not possible.

Organic sulfur in coal is thought to be uniformly distributed and firmly bound to the coal matrix. Precombustion physical coal cleaning to remove mineral matter is widely practiced in the coal industry. By the conventional float-sink methods as much as 60% of the pyritic sulfur in coal is also removed. However, a significant portion of coal is also rejected along with the high density material of high sulfur content. In addition, physical methods are not effective in removing organic sulfur content of coal which in certain cases may constitute 50% of the sulfur in coal. During the last decade several chemical coal cleaning methods have been proposed. However, a majority of these are applicable for the removal of only pyritic sulfur and no chemical coal desulfurization process uniformly applicable for the removal of both inorganic and organic sulfur fractions in coal is as yet available commercially.

Retention of sulfur during combustion is studied widely employing dolomite, limestone, etc. in fluidized bed combustion units. Chemical modification of coal and incorporation of alkaline earth metals into the coal matrix as a means of retaining sulfur in the ash have also been proposed. Amongst the postcombustion gas-cleaning methods, the most widely adopted one is flue gas desulfurization (FGD) employing wet scrubbers. However, scrubbers generate large quantities of sludge which has to be disposed of in an economical manner. Also in many instances scrubbers were found to be unreliable requiring excessive maintenance.

Amongst the various methods that have been proposed for controlling the $SO_2$ emissions from coal fired power plants, precombustion coal desulfurization offers several potential advantages over flue gas desulfurization. In the past decade, several processes have been proposed for extracting pyritic and organic sulfur from coal. Most of these processes can be classified into a few groups based on the chemistry of the reactions involved in the process.

Exposure of coal to air results in a slow oxidation of pyrite to the sulfate which is water soluble. A majority of the processes reported for the removal of pyritic sulfur in coal are aimed at enhancing this natural process of oxidation. Oxidants ranging from metal ions ($Fe^{3+}$) to strong acids ($HNO_3$), oxygen, air, $SO_2$, $Cl_2$, $H_2O_2$, $NO_2$, etc. have been employed for this purpose. The PETC oxydesulfurization process, AMES wet oxidation process, LEDGEMONT Oxygen Leaching Process, ARCO promoted oxydesulfurization process, TRW Meyers desulfurization process, and JPL chlorinolysis process amongst others, all involve oxidizing the sulfur fraction in coal to sulfuric acid or to a soluble sulfate. There is a wide variability in processing conditions and the removal efficiencies amongst the various processes.

Processes based on the displacement of sulfur such as the Battelle Hydrothermal process, TRW Gravimelt process and the General Electric Microwave process involve heating coal with sodium hydroxide to remove the sulfur in the form of sulfides and polysulfides. The TRW Gravimelt process in addition to removing sulfur also removes substantial quantities of mineral matter from coal. However, one major disadvantage of using caustic is that the excess sodium retained in coal may cause severe ash slagging problems in the boiler.

Amongst the processes based on reduction, mention may be made of the IGT flash desulfurization process for producing chars. The process involves preliminary air oxidation of coal to facilitate sulfur removal in the subsequent hydrodesulfurization step. A sulfur acceptor such as calcium oxide or iron oxide was found to limit the hydrogen consumption during the latter step.

The JPL Low Temperature Chlorinolysis process is one of the few processes capable of removing both inorganic and organic sulfur from coal. There are two basic variations of the process, although both are based on the oxidation of sulfur by chlorine. The original version (U.S. Pat. No. 4,081,250) employed methyl chloroform as the reaction medium during chlorination which was later substituted by water (U.S. Pat. No. 4,325,707) or methanol (U.S. Pat. No. 4,334,888). A more recent version of the process consists of:

(i) chlorination of an aqueous coal slurry (water:coal 2/1) at 60° C. for 45 min. ($Cl_2$/S 8/1 by wt.)

(ii) filtration—wash of chlorinated coal (coal:water $\frac{1}{2}$)

(iii) dechlorination of dry coal with $N_2$ at 400° C. for 1 hr., and/or (iv) advanced dechlorination with $H_2$ at 650° C. for 1 hr.

The last step was found to further enchance the total sulfur removal to the level of 90%. The chemistry of the process is somewhat complex, but is based on the sulfur bond scission in organic compounds. The reactions are exothermic and proceed favorably at low temperature.

Almost all of the precombustion desulfurization processes have been practiced in the liquid phase. There are very few processes in which coal has been desulfurized by treatment as a solid with a gas phase reagent.

Coal desulfurization by treatment with different gases at elevated temperatures was reported by several investigators. Early interest in such treatments was mainly for the production of metallurgical coke. Sulfur removal during carbonization was studied in both inert and reactive environments such as oxygen, hydrogen, steam, etc. Iron pyrites decompose on heating, releasing half of its sulfur, while $\frac{1}{4}$–$\frac{1}{3}$ of the organic sulfur is converted to hydrogen sulfide.

One investigator treated coal in various reactive gases and found hydrogen to be most effective. However, hydrodesulfurization of coal is strongly inhibited by the presence of hydrogen sulfide in the gas-phase. Treating with hydrogen at high temperatures (>900° C.) was found to be very effective in the removal of organic sulfur but the accompanying coal losses were found to be substantial.

Desulfurization of coal with oxygen and oxygen carriers was studied by several investigators. However, it was found that mainly pyritic sulfur was removed under the oxidizing atmosphere. One exception is the KVB or Guth process where the oxidation of sulfur compounds is brought about in the solid phase by employing $NO_2$ followed by a caustic wash to remove up to 40% of organic sulfur. $NO_2$ is reported to selectively oxidize part of the pyritic and organic sulfur in coal.

Coal has also been desulfurized or treated in various other processes. Long et al (U.S. Pat. No. 3,878,051) utilize a mixture of CO and $Cl_2$ (forms phosgene in situ) to desulfurize coke. Sauer (U.S. Pat. No. 1,052,592) teaches decolorizing carbon with heat and an active gas such as steam, $CO_2$, producer gas, CO, air or $Cl_2$. Hartwick (U.S. Pat. No. 2,698,777) purifies anthracite or coke with $Cl_2$ at elevated temperature to volatize metal impurities. Use of hydrogen to desulfurize coal or coke is taught by McKinley (U.S. Pat. No. 2,726,148) and Loevenstein (U.S. Pat. No. 3,130,133). Fluidized bed desulfurization is disclosed by Whitten (U.S. Pat. No. 3,759,673) who suspends coal in recycled reducing gas ($H_2$ plus methane) and then contacts coal with this gas mixture in a multi-stage contactor. Kreusi (U.S. Pat. No. 4,118,200) desulfurized coal in a liquid salt bath in the presence of chlorine.

Thus, while numerous chemical coal cleaning processes have been proposed in the past decade, none are being practiced on a commercial scale at this time. There are inherent technical and economic problems still to be overcome. Most of these processes besides being effective for the removal of only pyritic sulfur involve severe operating conditions, long retention times and multiple processing steps. In addition, a majority of these processes are carried out in the liquid phase, thus necessitating a phase change at the beginning and end of the process.

STATEMENT OF THE INVENTION

The desulfurization process of the invention uses less chlorine reagent than the low temperature chlorinolysis process. The process of the invention provides equivalent sulfur removal in a shorter retention period in the reactor. The process also provides more efficient mixing of the coal and reagent and more effective mass transfer of the chlorine reagent into the coal and reaction products out of the porous coal structure. The process of the invention also eliminates liquid effluents which can pose disposal problems.

In the process of the invention, coal desulfurization takes place by suspending coal in a fluidized bed of chlorine gas. The principal desulfurization reactions are brought about in the solid phase itself, thus eliminating the use of liquid phase reactions and the attendant costs. The chlorine requirement is reduced in the reaction since the products of reaction are gas-phase species instead of sulfuric acid or sulfates as in the liquid phase processes. Shorter retention times and isothermal operation are a consequence of efficient solids mixing provided by the fluidized bed reactor. There are fewer processing steps and greater flexibility in operation. Coal desulfurization in a fluidized bed reactor thus provides a novel commercial method for converting higher sulfur coals to environmentally acceptable clean solid fuels and constitutes a significant technological advancement for chemical coal cleaning.

The efficient solids mixing provided by a fluidized bed reactor promotes good gas-solid mixing and isothermal operation. This is particularly beneficial since the reaction of chlorine with coal is exothermic. The process can also include chlorination, dechlorination and/or hydrodesulfurization in the same fluidized bed reactor by sequentially employing chlorine, nitrogen and/or hydrogen as the fluidizing gases, respectively. Since the products of sulfurchlorine reaction are primarily gas-phase species in contrast to sulfuric acid in the liquid-phase process, there is considerable reduction in chlorine requirement. The reduced chlorine consumption coupled with shorter retention times results in substantial reduction in processing costs. A high degree of sulfur reduction is achieved by coal desulfurization in a fluidized bed according to the invention.

Preliminary experimental results on coal desulfurization in a fluidized bed reactor operated according to the process of the invention have demonstrated the potential of the process in providing a simple and cost effective method of converting high sulfur coals to environmentally acceptable solid fuels for power plants and utility boilers. The results indicate that coal desulfurization achieved in the fluidized bed process is comparable to that achieved in a coal-water slurry system. Chlorination times as low as 5 minutes were found to result in desulfurization levels of the order of 60%. This represents a substantial reduction in the chlorination time as compared to the slurry process and hence the reactor cost. Since dry coal is used as the feed to the fluidized bed reactor, the coal sulfur leaves as gaseous species from the chlorination reactor which is likely to result in reduced chlorine requirement in the process. This was also evident from the fact that a mixture of nitrogen and chlorine in the proportion of 4:1 during chlorination did not significantly reduce the extent of coal desulfurization. Since chlorine cost represents a substantial portion of the overall process cost, the reduced chlorine requirement will have a very significant effect on the process economics.

Dechlorination and hydrodesulfurization of the chlorinated coal has been demonstrated in 10 minutes in the fluidized bed reactor which represents a substantial reduction over the time required in the slurry process. A fluidized bed reactor provides much better mixing of the coal particles and contact between the gas-solid phase, thereby facilitating better process control and isothermal operation. Thermal efficiency of the overall process will be high, since all the reaction steps are brought about in the solid phase itself.

These and many other features and attendant advantages of the invention will become apparent as the invention becomes better understood by reference to the following detailed description when considered in conjunction with the accompanying drawings.

DETAILED DESCRIPTION OF THE INVENTION

Figure 1:
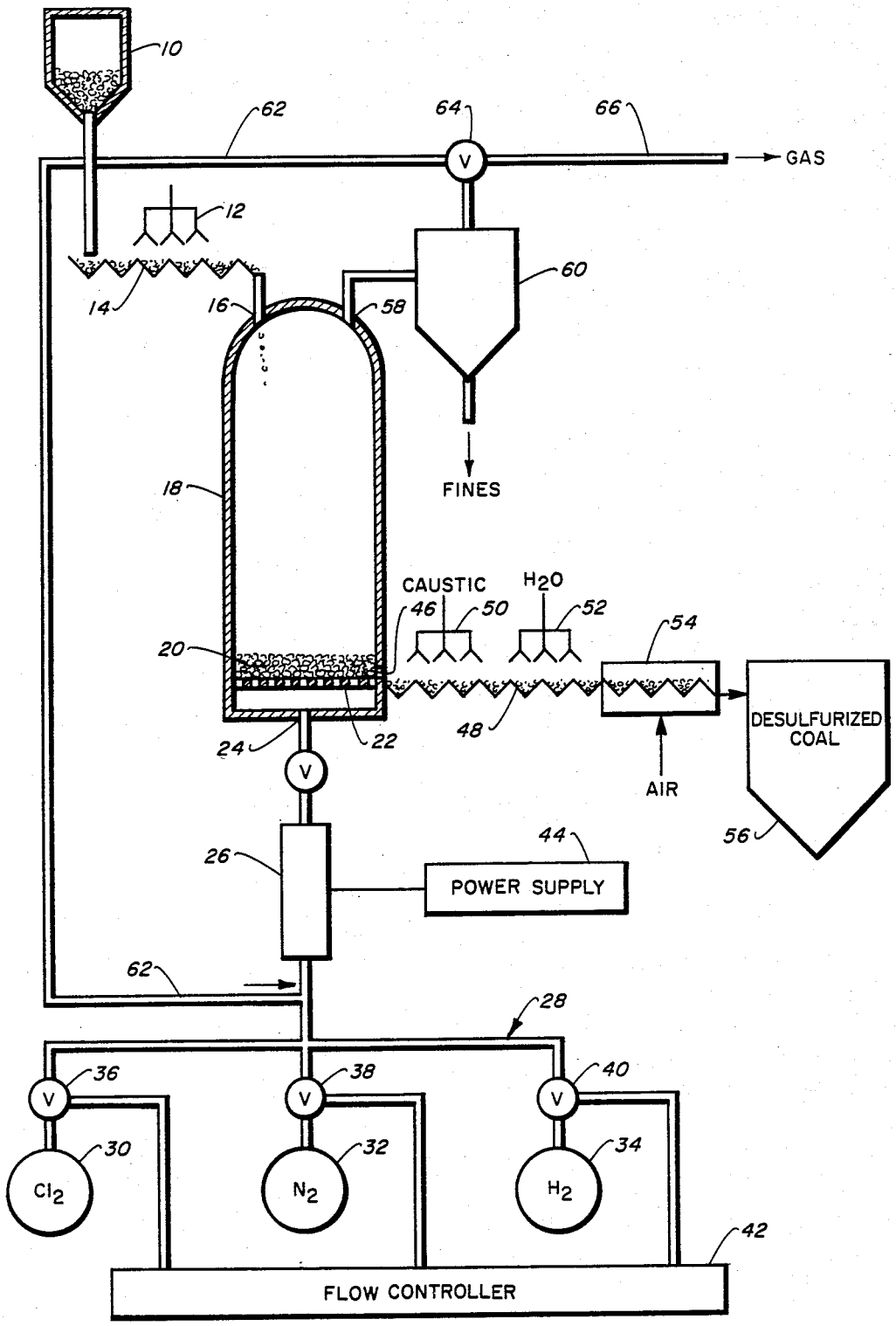
FIG. 1 is a schematic view of a batch fluidized reactor system for coal desulfurization in accordance with this invention.

In the process of the invention, pulverized coal is suspended in hot chlorine gas and reacted for an appropriate period, usually 1 to 60 minutes, typically from 5 to 30 minutes. The chlorine can be at ambient temperature (20° C.) up to 300° C., usually from 50° C. to 150° C. If chlorination is conducted at low temperature, the temperature will rise to about 80° C. from the exothermic heat released by reaction of chlorine with sulfur.

The amount of chlorine added to the coal depends on the size of the coal, duration and temperature of the chlorine, chlorine flow rate and amount of sulfur in the coal. Typically from 1 to 10% by weight chlorine is added to high sulfur coal containing at least 1% by weight of sulfur.

After the chlorination step, the coal is dechlorinated by suspension in an inert or reducing gas, such as nitrogen or hydrogen heated to a temperature of 300° C. to 600° C. Dechlorination generally requires from 5 to 60 minutes, usually 10 to 30 minutes. The chlorine content is reduced to below 1% by weight, preferably no more than 0.1% by weight. Increased desulfurization is achieved by further hydrodesulfurization treatment. The dechlorinated coal may optionally be subjected to further desulfurization by suspension in hydrogen at a temperature of 500° C. to 700° C. for 5 minutes to 120 minutes, usually 10 to 60 minutes. Either of the reactive chlorine or hydrogen gases can be diluted in amounts up to 90% with an inert gas, such as nitrogen. The coal can be initially suspended in hot, inert gas and heated to reaction temperature before introducing the reactive gas.

The coal may be washed before and after treatment. Washing the untreated coal removes some pyrites. Washing the treated coal with dilute caustic, such as 5 to 20% alkali metal carbonate and/or water can be utilized to remove mineral or ash impurities before the treated coal is sent to a boiler or power plant for combustion.

The process is capable of desulfurizing diverse types of organic material in addition to coal such as petroleum, oil shale, industrial waste, particularly black liquor residue from sulfate or sulfite pumping. The coals suitable for desulfurization treatment in accordance with this invention can be bituminous, sub-bituminous or lignite containing at least 0.2% sulfur. Pulverization aids the chlorinolysis reaction rate. Typically, the coal will be pulverized to 40 to 350 mesh, usually from 100 to 200 mesh.

Referring now to FIG. 1, coal from hopper 10 is washed by spray heads 12 as it moves along screen conveyor 14 to the inlet 16 to the fluidized bed reactor 18. A fluidized bed 20 of coal forms above the screen member 22 by force of the fluidizing gas entering bottom inlet 24. The inlet 24 is connected to a heater 26 and a manifold 28. The heater is powered by power supply 44. The manifold is connected to a source 30 of chlorine gas, a source 32 of nitrogen gas and optionally, a source 34 of hydrogen gas. Each source contains a flow control device 36, 38, 40, such as a servo operated flow control valve which is connected to a flow controller 42.

The treated coal is removed from the reactor 18 through outlet 46 and is conveyed on screen conveyor 48 past a caustic wash station 50 and water wash station 52 and through drier 54 before storage in a bin 56. The fluidizing gases leave the reactor through a top outlet 58 connected to a separator 60 which separates fines from the gas. The fines can be processed by pelletizing or briquetting or burned to supply process heat. The gas can be recycled through line 62 by means of bypass valve 64.

The apparatus is operated by opening valve 38 and turning on power supply 44 to establish a flow of heated gas. Valve 64 is turned toward bypass line 62. Washed coal is fed into the reactor and a fluidized suspension established. The desired amount of chlorine gas is then fed into the inlet 24 by means of a controller 42 actuating valve 36. Valve 64 is now turned toward vent line 66. Vent line 66 may contain scrubbers as required by environmental needs. After chlorination is completed, flow controller closes valve 36 and opens valve 40 to feed hydrogen into the fluidized bed 20. When hydrodesulfurization is completed, the controller 42 closes all valves and the power supply 44 is turned off. Outlet 46 is opened and the coal is washed, dried and collected in the storage bin.

Desulfurization of high volatile bituminous coals (Illinois No. 6 and Ohio No. 8) was conducted in a laboratory scale batch fluidized bed reactor.

For the laboratory scale experiments, the ground coals were sieved to the required size fractions using a Sweco Vibro-Energy separator equipped with 60, 100 and 200 mesh, stainless steel screens. Results of sulfur forms, and proximate and ultimate analyses are presented in Tables 1 and 2.

reached the required temperature, the chlorination experiment is started by substituting chlorine as the fluidizing medium at the predetermined flow rate (approximately 1.00 SCFH) for the desired reaction period (5–15 min.). During the initial stages of chlorination, the temperature of the bed rose sharply. However, the vigorous mixing of solids in the reactor prevented any local hot spots and by proper insulation, the reactor temperature could be maintained uniformly at about 100° C. without supplying any additional heating. During preliminary runs employing coal as received (without drying), it was observed that the bed tends to consolidate as a consequence of the exothermic sulfur-chlorine reaction, resulting in defluidization and pressure buildup in the reactor. This was overcome by employing dried coal (dried at 100° C. overnight) in all the subsequent experiments. The chlorination experiments lasted from 5–15 mins. Unreacted chlorine and the products of chlorine-sulfur reactions are absorbed in

TABLE 1

CHARACTERISTICS OF RAW COALS EMPLOYED IN THE STUDIES

| PSOC No. | Coal Type, Seam County, State | Size Tyler Mesh | Forms of Sulfur (wt %)[a,b] Organic | Pyritic | Sulfate | Total | Total Sulfur (wt %)[b,c] |
|---|---|---|---|---|---|---|---|
| 276 | High volatile, bituminous Pittsburgh coal from Harrison County, Ohio, George Town, No. 24 Mine | −60 + 100 | 1.17 | 2.63 | 0.06 | 3.87 | 3.75 |
| 282 | High volatile, bituminous Illinois No. 6 coal from Jefferson County, Illinois, No. 6 Mine, (Washed)[d] | −60 + 100 | 0.75 | 0.43 | 0.36 | 1.54 | 1.58 |

[a]Determined by CSMRI
[b]Dry Basis
[c]LECO Analysis
[d]Unwashed Coal had 2.2 (wt %) Total Sulfur

TABLE 2

PROXIMATE AND ULTIMATE ANALYSES OF RAW COALS EMPLOYED IN THE STUDIES

| Coal | Proximate Analysis (wt %)[a] Volatile Matter | Fixed Carbon | Ash | Moisture[b] | Heating Value[c], Btu/lb | Ultimate Analysis (wt %)[a] C | H | S | N | Cl[d] | O | Ash |
|---|---|---|---|---|---|---|---|---|---|---|---|---|
| PSOC 276 | 37.2 | 51.3 | 11.5 | 1.89 | 12,755 | 71.6 | 5.67 | 3.91 | 1.28 | 0.16 | 5.87 | 11.6 |
| PSOC 282 | 33.8 | 59.5 | 6.70 | 3.10 | 13,092 | 74.8 | 4.82 | 1.60 | 1.69 | 0.47 | 9.92 | 6.70 |

[a]Dry Basis
[b]As Determined Basis
[c]High Heating Value, Dry Basis
[d]LECO Analysis gave 0.178% and 0.478% for PSOC 276 and PSOC 282 Coals respectively The experimental apparatus consisted of a quartz tube fluidized bed reactor (1" I.D.×24" long), a preheater, reflux condenser and scrubber, with appropriate temperature control and flow metering devices. The minimum fluidization velocity for the coals of the required particle sizes was determined in initial experiments.

Figure 2:
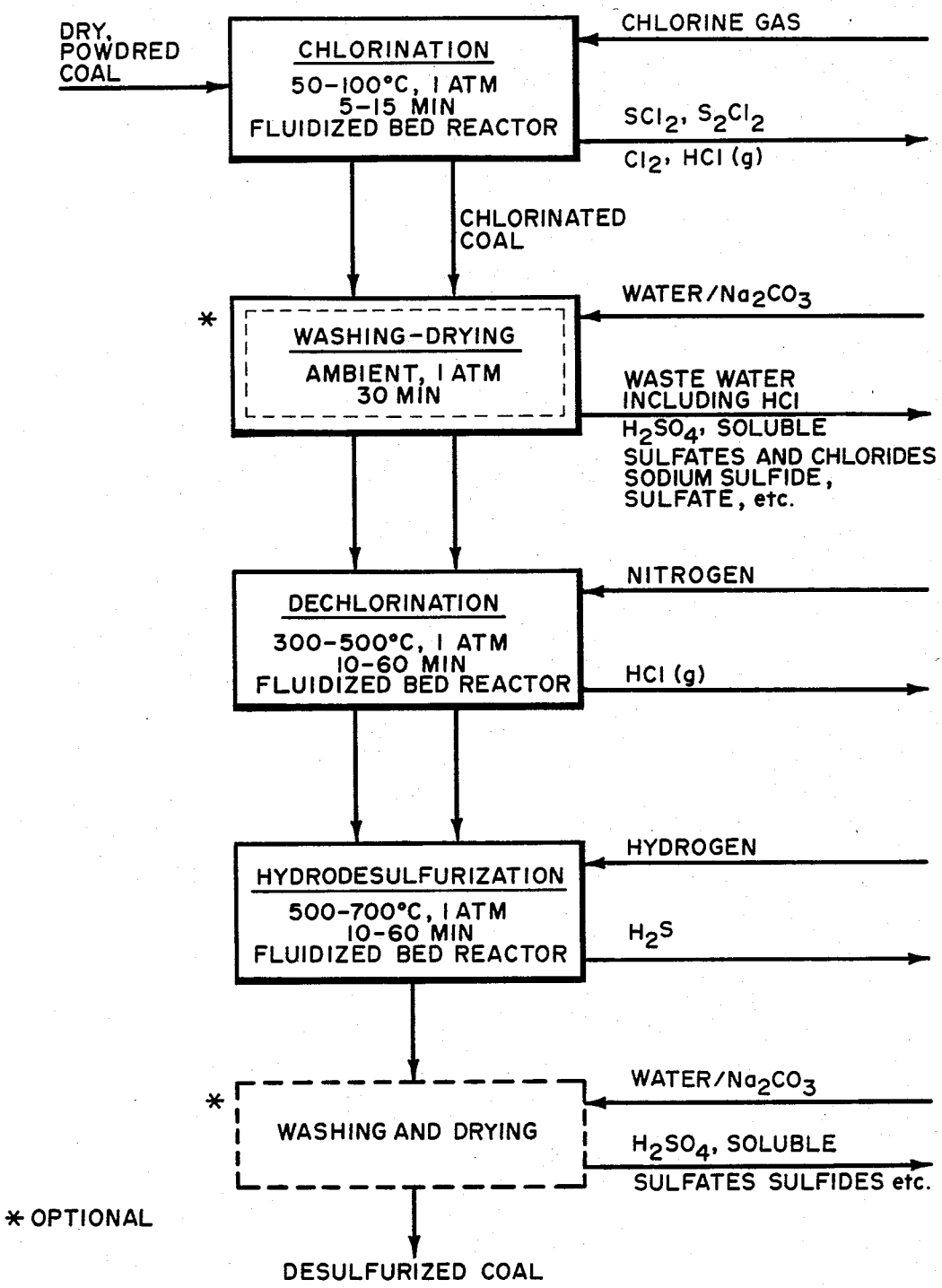
FIG. 2 is a process flow diagram for fluidized bed coal desulfurization according to the invention.

The desulfurization experiments consisted of successive chlorination, dechlorination and/or hydrodesulfurization of selected coals for varying time intervals and temperatures in the fluidized state. The effect of employing a mixture of nitrogen and chlorine (4:1) and pre- and post-treatments to coals was also studied. A process flow diagram of the treatments is presented in FIG. 2.

The experimental procedure is as follows: 50 g of coal of the required particle size are loaded into the reactor and fluidized with nitrogen. After ensuring that the entire system is functioning properly, and the preheater 1M $Na_2CO_3$ solution in the scrubber.

After chlorination, nitrogen is substituted as the fluidizing medium and the reactor temperature is set to the required level. After the reactor attained the required temperature (400°–600° C.), dechlorination is carried out for time intervals varying from 10–60 min.

For the hydrodesulfurization step, the reactor temperature is set to the required level while still being fluidized with nitrogen. After the reactor attained the required temperature, hydrogen is substituted as the fluidizing medium and the hydrodesulfurization of coal is carried out for time intervals ranging from 10–30 min. in the temperature range of 500°–700° C.

After completing the hydrodesulfurization experiment, the heaters are switched off, hydrogen flow is stopped and nitrogen is once again substituted as the fluidizing medium. The reactor is cooled to room temperature in a nitrogen atmosphere.

After the experiment, the reactor is disconnected from the system and the reacted coal is collected and stored for subsequent analyses.

In some cases, raw coal, chlorinated coal and product coal are subjected to a washing treatment consisting of (i) water wash and (ii) carbonate wash. For a water wash, the sample is soaked in distilled water with occasional stirring for 30 min. after which the coal is filtered and dried overnight at 100° C. In the case of a carbonate wash, the sample is soaked in 1M $Na_2CO_3$ solution for 30 min. with frequent stirring after which the coal is filtered, washed repeatedly till the washings are neutral to litmus and dried at 100° C. overnight.

A total of 26 experiments were conducted to investigate the effects of: (i) chlorination, dechlorination and hydrodesulfurization as a function of reaction time and temperature, (ii) pre- and post-treatment of raw and processed coals, and (iii) changing chlorine concentration during chlorination on total sulfur reductions in coals. The ranges of variables studied are as follows:

(i) Coal Type: PSOC 276 and PSOC 282

(ii) Particle Size: −60+100 and −100+200 Tyler Mesh (iii) Chlorination Time: 5–15 minutes (iv) Chlorination Temperature: Approx. 20° C.–250° C.

(v) Chlorine Concentration: Pure chlorine and a mixture of 1:4 chlorine and nitrogen (vi) Dechlorination Time: 10–60 minutes (vii) Dechlorination Temperature: 300°–500° C.

(viii) Hydrodesulfurization Time: 10–30 minutes (ix) Hydrodesulfurization Temperature: 500°–700° C.

(x) Pre- and Post-Treatments to Coal: These consisted of carbonate wash of chlorinated and product coals.

Figure 3:
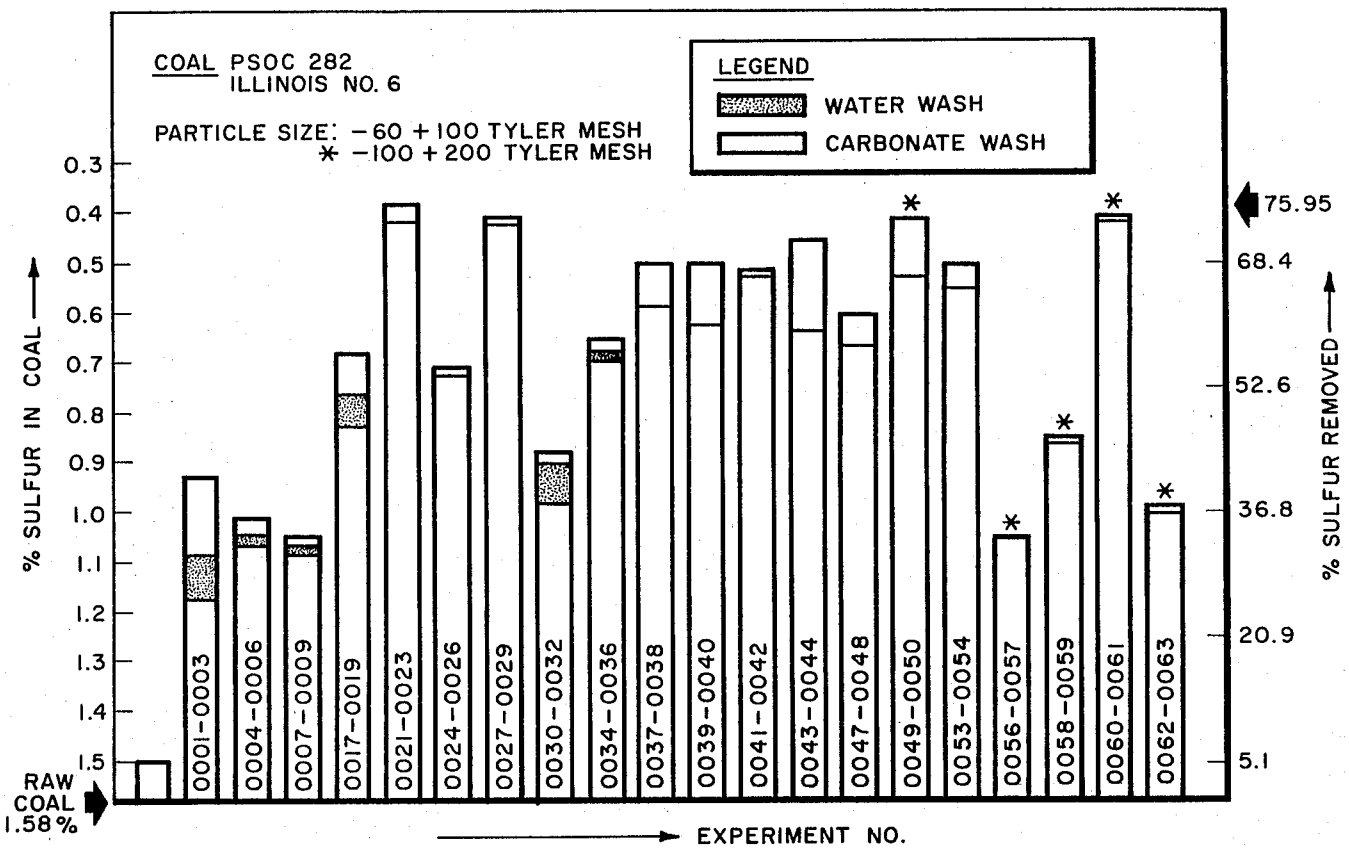
FIG. 3 is a bar graph of a set of experiments on PSOC 282 coal showing amount of sulfur removed.
Figure 4:
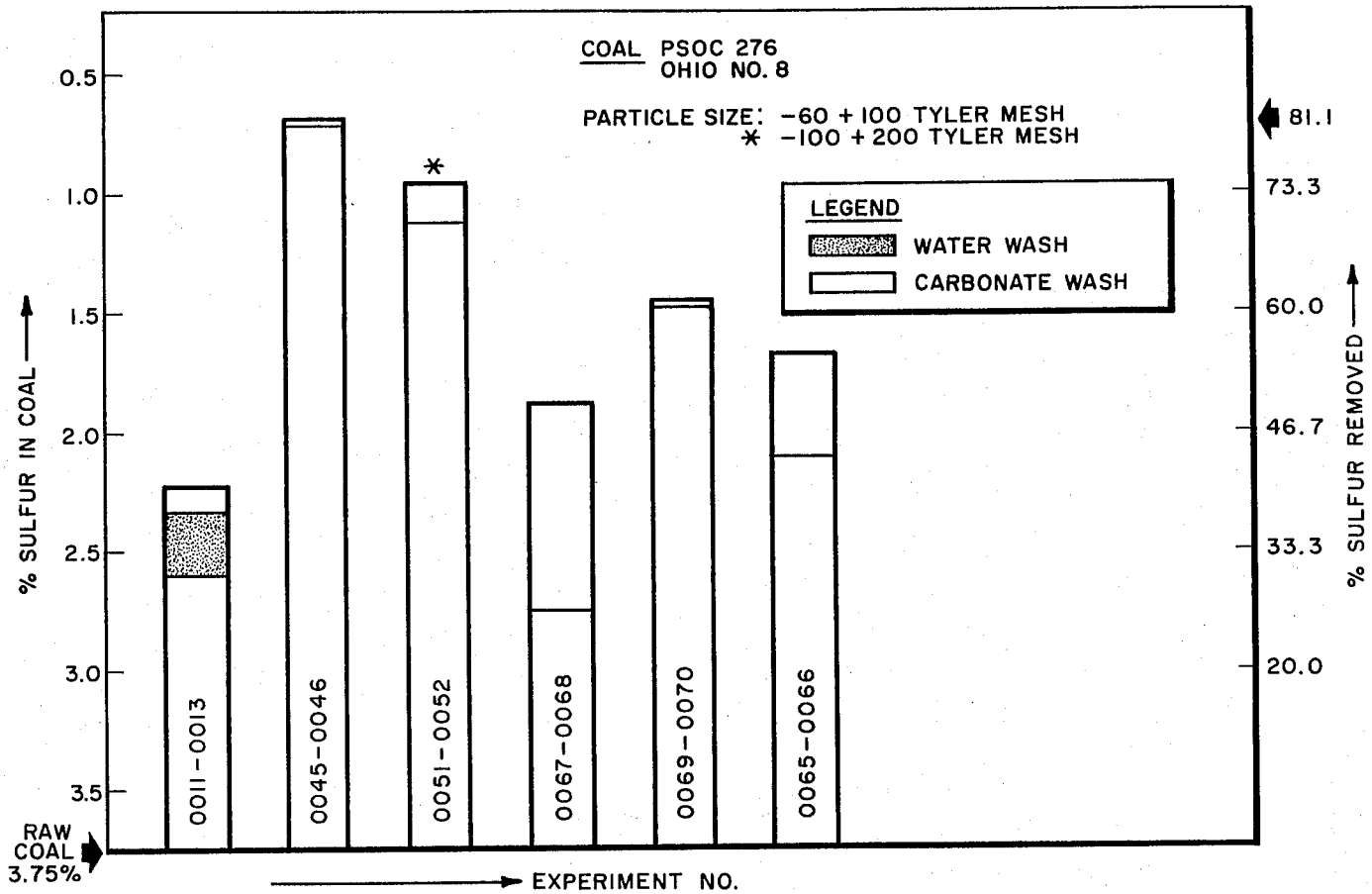
FIG. 4 is a bar graph of a second set of experiments on PSOC 276 coal showing amount of sulfur removed.

Experimental conditions and results in the form of total sulfur estimation by Leco Analyses are presented in Tables 3 and 4. Results are also depicted in FIGS. 3 and 4. Results of complete analysis of selected coals are presented in Tables 5–8.

A total of 20 experiments were conducted on PSOC 282 coal to assess the influence of various process parameters on the extent of desulfurization in the fluidized bed reactor.

A maximum of 74% desulfurization (Runs 0021 and 0027) was achieved in the process based on 1.581% total sulfur in the raw coal. However, based on the sulfur content of unwashed coal (2.2% total sulfur) the level of desulfurization works out to be 81%.

Chlorination in general was carried out at about 10° C. for 15 min. In certain cases, chlorination for as short a time interval at 5 min. (Runs 0037, 0047, 0062) as well as at 250° C. (Run 0053) was also carried out. The effect of changing chlorine concentration by employing a 4:1 mixture of nitrogen to chlorine (Run 0041) was also studied. However, due to the high levels of chlorine that are likely to exist in chlorinated coals prior to dechlorination, sulfur estimation in chlorinated coals could not be carried out due to interferences in the Leco method. Consequently, these results are discussed based on sulfur estimations of the product coals in the subsequent sections on dechlorination and hydrodesulfurization. Results are presented in Table 3.

TABLE 3

EXPERIMENTAL CONDITIONS AND RESULTS

COAL: PSOC 282, Illinois No. 6 (−60 + 100 Tyler Mesh) Total Sulfur: 1.581 (Wt %)*

| Experiment No. | Chlorination | Intermediate Wash | Dechlorination with Nitrogen | Advanced Dechlorination with Hydrogen | Post-Treatment | % Total Sulfur in Product* | % Desulfurization |
|---|---|---|---|---|---|---|---|
| 0001 | 15 min., ambient | — | 30 min., 400° C. | — | — | 1.170 | 26.1 |
| 0002 | " | — | " | — | water wash | 1.082 | 31.6 |
| 0003 | " | — | " | — | carbonate wash[a] | 0.925 | 41.5 |
| 0004 | 15 min., ambient | — | 60 min., 400° C. | — | — | 1.06 | 32.7 |
| 0005 | " | — | " | — | water wash | 1.04 | 34.2 |
| 0006 | " | — | " | — | carbonate wash | 1.01 | 35.9 |
| 0007 | 15 min., ambient | — | 30 min., 500° C. | — | — | 1.07 | 32.2 |
| 0008 | " | — | " | " | water wash | 1.06 | 32.7 |
| 0009 | " | — | " | " | carbonate wash | 1.05 | 32.8 |
| 0010 | — | carbonate wash[a] | — | — | — | 1.50 | 5.1 |
| 0017 | 15 min., 100° C. | — | — | 30 min., 600° C. | — | 0.82 | 48.4 |
| 0018 | " | — | — | " | water wash | 0.76 | 52.1 |
| 0019 | " | — | — | " | carbonate wash | 0.68 | 57.2 |
| 0020 | 15 min., 100° C. | — | — | — | — | — | — |
| 0021 | 15 min., 100° C. | carbonate wash[a] | — | 30 min., 600° C. | — | 0.41 | 74.1 |
| 0022 | " | " | — | " | water wash | 0.41 | 74.1 |
| 0023 | " | " | — | " | carbonate wash | 0.38 | 76.0 |
| 0024 | 15 min., 100° C. | water wash | — | 30 min., 600° C. | — | 0.72 | 54.6 |
| 0025 | " | " | — | " | water wash | 0.72 | 54.6 |
| 0026 | " | " | — | " | carbonate wash | 0.71 | 55.1 |
| 0027 | 15 min., 100° C. | carbonate wash | — | 30 min., 700° C. | — | 0.41 | 74.1 |
| 0028 | " | " | — | " | water wash | 0.41 | 74.1 |
| 0029 | " | " | — | " | carbonate wash | 0.41 | 74.1 |
| 0030 | — | — | — | 30 min., 600° C. | — | 0.976 | 38.3 |
| 0031 | — | — | — | " | water wash | 0.902 | 42.9 |
| 0032 | — | — | — | " | carbonate wash | 0.883 | 44.1 |
| 0033 | 15 min., 100° C. | — | — | — | carbonate wash | — | — |
| 0034 | 15 min., 100° C. | carbonate wash | — | 30 min., 500° C. | — | 0.690 | 56.3 |
| 0035 | " | " | — | " | water wash | 0.677 | 57.2 |
| 0036 | " | " | — | " | carbonate wash | 0.652 | 58.7 |
| 0037 | 5 min., 100° C. | carbonate wash | — | 30 min., 700° C. | — | 0.581 | 63.2 |
| 0038 | " | " | — | " | carbonate wash | 0.498 | 68.5 |
| 0039[b] | 15 min., 100° C. | — | — | 30 min., 700° C. | — | 0.614 | 61.1 |
| 0040[b] | " | — | — | " | carbonate wash | 0.496 | 68.6 |

TABLE 3-continued

EXPERIMENTAL CONDITIONS AND RESULTS

COAL: PSOC 282, Illinois No. 6 (−60 + 100 Tyler Mesh) Total Sulfur: 1.581 (Wt %)*

| Experiment No. | Chlorination | Intermediate Wash | Dechlorination with Nitrogen | Advanced Dechlorination with Hydrogen | Post-Treatment | % Total Sulfur in Product* | % Desulfurization |
|---|---|---|---|---|---|---|---|
| 0041[c] | 15 min., 100° C. | carbonate wash | — | 30 min., 700° C. | — | 0.517 | 67.3 |
| 0042[c] | " | " | — | " | carbonate wash | 0.517 | 67.3 |
| 0043 | 15 min., 100° C. | carbonate wash | — | 10 min., 700° C. | — | 0.632 | 60.0 |
| 0044 | " | " | — | " | carbonate wash | 0.449 | 71.6 |
| 0047 | 5 min., 100° C. | carbonate wash | — | 10 min., 700° C. | — | 0.662 | 58.1 |
| 0048 | " | " | — | " | carbonate wash | 0.600 | 62.0 |
| 0049[d] | 15 min., 100° C. | carbonate wash | — | 30 min., 700° C. | — | 0.521 | 67.0 |
| 0050[d] | " | " | — | " | carbonate wash | 0.409 | 74.1 |
| 0053 | 15 min., 250° C. | carbonate wash | — | 30 min., 700° C. | — | 0.547 | 65.4 |
| 0054 | " | " | — | " | carbonate wash | 0.500 | 68.4 |
| 0055 | 15 min., 100° C. | — | — | — | — | 1.09 | 29.2 |
| 0056[d] | 15 min., 100° C. | — | 30 min., 400° C. | — | — | 1.076 | 31.9 |
| 0057[d] | " | — | " | — | carbonate wash | 1.052 | 33.5 |
| 0058[d] | 15 min., 100° C. | — | 30 min., 400° C. | 30 min., 700° C. | — | 0.849 | 46.3 |
| 0059[d] | " | — | " | " | carbonate wash | 0.850 | 46.2 |
| 0060[d] | 15 min., 100° C. | carbonate wash | — | 30 min., 700° C. | — | 0.412 | 73.9 |
| 0061[d] | " | " | — | " | carbonate wash | 0.410 | 74.1 |
| 0062[d] | 5 min., 100° C. | — | — | 10 min., 700° C. | — | 0.990 | 37.4 |
| 0063[d] | " | — | — | " | carbonate wash | 0.985 | 37.7 |

*LECO Analysis
[a]Soaked in 10% $Na_2CO_3$ Solution for 30 min. followed by washing with distilled water till free of alkali and dried
[b]Coal initially washed with 10% $Na_2CO_3$ Solution and dried
[c]Chlorination with a 4:1 mixture of nitrogen and chlorine
[d]−100 + 200 Tyler Mesh Dechlorination of chlorinated coals by nitrogen was carried out at 400°–600° C. for 30 min. In general, dechlorination at higher temperatures did not result in any significant change in the desulfurization levels achieved. However, at the same time, longer times and higher temperatures during dechlorination were found to be effective to a limited extent in reducing the chlorine levels in product coals.

Substitution of hydrogen during dechlorination was found to further enhance the desulfurization levels achieved. In fact, dechlorination-cumhydrodesulfurization by hydrogen was found to be much more superior to dechlorination by nitrogen alone or successive dechlorination and hydrodesulfurization. Hydrodesulfurization was carried out at atmospheric pressure for 10–30 min. at 500°–700° C.

Hydrodesulfurization of chlorinated coal at 600° C. resulted in increasing the level of desulfurization to 48% (Run 0017) compared to the 30% with nitrogen. While the increase in the level of desulfurization is not significant, in fact raw coal itself was desulfurized to the extent of 38% at 600° C., the reduction in the chlorine level was substantial.

Treatment for coal prior to hydrodesulfurization as well as hydrodesulfurized coals resulted in a very marked increase in the desulfurization levels achieved as indicated by the results presented in Table 3. A carbonate wash to the chlorinated coals prior to hydrodesulfurization was much more effective than a water wash. An intermediate carbonate wash increased the level of desulfurization to 74% (Run 0021) compared to 48% achieved with no wash at all (Run 0017), while a simple water wash resulted in only 55% desulfurization. The data presented in Table 3 also indicate that a subsequent wash to hydrodesulfurized coals which were treated with carbonate prior to hydrodesulfurization did not significantly enhance the level of desulfurization. The substantial reduction in sulfur levels in coals as a consequence of carbonate treatment to chlorinated coals is likely due to the removal of organic sulfur by alkali. It is known that alkali treatment of coal results in the removal of both pyritic and organic forms of sulfur, more so if the coal was initially subjected to an oxidation treatment. The minor reductions in sulfur levels achieved by subjecting product coals to a carbonate wash may be the result of trapping sulfur in the ash during combustion by sodium ions that might have been retained in the coal. It is reported that alkaline metals such as sodium, calcium, etc. either chemically bound to coal or in a physical mixture with coal are capable of reducing potential sulfur emissions during coal combustion by trapping the sulfur in the ash as sulfate.

Treating raw coal with carbonate solution prior to desulfurization resulted in achieving a desulfurization level of 61% (Run 0039).

Since gaseous chlorine was employed as the fluidizing medium, chlorine requirement in the process could be reduced by either reducing the time of reaction or by reducing the chlorine concentration in the feed by diluting it with an inert gas. Both these alternatives were found to result in high levels of desulfurization. By chlorinating for only 5 min. (Run 0037) as much as 63% desulfurization was achieved while employing a mixture of 4:1 nitrogen and chlorine during chlorination (Run 0039) gave 61% desulfurization.

It was found that even the time of hydrodesulfurization could be reduced without sacrificing the level of desulfurization as indicated by Run 0043 where 60% desulfurization was achieved. In fact, even reducing by as much as ⅓ both the time of chlorination and hydrodesulfurization (Run 0047), 58% desulfurization was achieved. The above data clearly shows that shorter reaction times and lower reactant concentrations could be employed while still achieving higher levels of desulfurization.

Higher temperature during chlorination did not result in any significant enhancement of the level of desulfurization as indicated by Run 0053 where 250° C. during chlorination resulted in only 65% desulfurization.

Particle size also did not have a significant effect within the range of particle sizes studied. (Compare Runs 0027 and 0060 for −60+100 mesh and −100+200 mesh, respectively.)

A limited number of experiments were conducted employing PSOC 276 coal. The data are presented in Table 4.

TABLE 4

EXPERIMETAL CONDITIONS AND RESULTS

COAL: PSOC 276, Ohio No. 8 (−60 + 100 Tyler Mesh) Total Sulfur: 3.75 (Wt %)*

| Experiment No. | Chlorination | Intermediate Wash | Dechlorination with Nitrogen | Advanced Dechlorination with Hydrogen | Post-Treatment | % Total Sulfur in Product* | % Desulfurization |
|---|---|---|---|---|---|---|---|
| 0011 | 15 min., 100° C. | — | 30 min., 400° C. | 30 min., 600° C. | — | 2.60 | 30.6 |
| 0012 | " | — | " | " | water wash | 2.33 | 37.9 |
| 0013 | " | — | " | " | carbonate wash[a] | 2.23 | 40.5 |
| 0045 | 15 min., 100° C. | carbonate wash[a] | — | 30 min., 700° C. | — | 0.708 | 81.1 |
| 0046 | " | " | — | " | carbonate wash | 0.699 | 81.3 |
| 0051[b] | 15 min., 100° C. | carbonate wash | — | 30 min., 700° C. | — | 1.113 | 70.3 |
| 0052[b] | " | " | — | " | carbonate wash | 0.943 | 74.9 |
| 0064 | 5 min., 100° C. | — | — | — | — | 2.81 | 27.4 |
| 0065 | 30 min., 100° C. | — | 30 min., 600° C. | 30 min., 700° C. | — | 2.11 | 43.7 |
| 0066 | " | — | " | " | carbonate wash | 1.67 | 55.5 |
| 0067 | 5 min., 100° C. | — | 10 min., 600° C. | 10 min., 700° C. | — | 2.750 | 26.7 |
| 0068 | " | — | " | " | carbonate wash | 1.870 | 50.1 |
| 0069 | 5 min., 100° C. | Carbonate wash | 10 min., 600° C. | 10 min., 700° C. | — | 1.47 | 60.8 |
| 0070 | " | " | " | " | carbonate wash | 1.46 | 60.9 |

*LECO Analysis

[a]Soaked in 10% $Na_2CO_3$ Solution for 30 min. followed by washing with distilled water till free of alkali and dried

[b]−100 + 200 Tyler Mesh

The maximum level of desulfurization achieved was once again 81% (Run 0045). The general trend was the same as with PSOC 282 coal in that:

(i) Substitution of hydrogen during dechlorination markedly improved the level of desulfurization.

(ii) Particle size did not have any effect in the range of sizes studied.

(iii) Even 5 minutes of chlorination and 10 min. dechlorination-cum-hydrodesulfurization resulted in 60% desulfurization.

(iv) Carbonate wash prior to hydrodesulfurization significantly enhanced the level of desulfurization.

(v) Longer times of chlorination and dechlorination did not enhance desulfurization.

SEM photographs of raw and desulfurized coals have shown that the desulfurization treatments bring changes in the gross physical structure of coal. Not only the coal surfaces after the treatments appear to be clean, they in addition developed cracks and rough surfaces indicative of a breakdown of physical structure and loss of material from the surface.

The EDAX spectra have shown that the sulfur peaks in the desulfurization coals are reduced compared to the raw coals. Apart from some reductions in the Al and Si levels in the desulfurized coals, the treatments did not result in any significant enhancement in either chlorine or sodium retained in the product coal. Comparison of spectra of carbonate washed PSOC 282 and 276 coals with that of raw coal indicated that the wash resulted in reduction of sulfur and mineral matter which is also supported by the SEM photographs.

Ten coal samples from typical experiments were analysed at Colorado School of Mines Research Institute for total sulfur and sulfur forms by ASTM approved methods. In general, the total sulfur estimations by Leco Acid-Base Analysis were in good agreement with the Colorado School of Mines Research Institute values. Some anomalies were observed in the Colorado School of Mines Research Institute results on sulfur forms such as an increase in organic sulfur fraction in coal after desulfurization in spite of substantial reductions in total sulfur, pyritic sulfur and sulfate sulfur. This anomaly is more likely to be due to the analytical bias rather than by any transformation of pyritic sulfur to organic form. In view of the fact that organic sulfur is calculated by difference, any errors in estimating total iron and pyritic iron could lead to such anomalies. Thus more precise methods for characterizing sulfur distribution in coal as well as for the direct estimation of organic sulfur are needed.

Samples from six typical experiments on PSOC 282 coal were analyzed for total sulfur and sulfur forms. The results are presented in Table 5.

TABLE 5

TOTAL SULFUR AND FORMS OF SULFUR IN SELECTED PRODUCT COALS* (PSOC 282)

| Sample No. | Experiment[a] No. | Total Sulfur[b] wt % | Total Sulfur[b] % Removed | Pyritic Sulfur[b] wt % | Pyritic Sulfur[b] % Removed | Sulfate Sulfur[b] wt % | Sulfate Sulfur[b] % Removed | Organic Sulfur[b,c] wt % | Organic Sulfur[b,c] % Removed |
|---|---|---|---|---|---|---|---|---|---|
| — | Raw Coal | 1.54 | — | 0.43 | — | 0.36 | — | 0.75 | — |
| 1 | 0017 | 0.84 | 45.4 | 0.04 | 90.7 | <0.05 | 86.1 | 0.80 | +6.7 |
| 2 | 0039[d] | 0.63 | 59.1 | 0.04 | 90.7 | <0.05 | 86.1 | 0.59 | 21.3 |
| 3 | 0041[e] | 0.58 | 62.3 | 0.03 | 93.0 | <0.05 | 86.1 | 0.55 | 26.7 |
| 5 | 0055[f] | 1.09 | 29.2 | 0.22 | 48.8 | 0.29 | 19.5 | 0.58 | 22.7 |
| 6 | 0058 | 0.81 | 47.4 | 0.03 | 93.0 | <0.05 | 86.1 | 0.78 | +4.0 |

TABLE 5-continued

TOTAL SULFUR AND FORMS OF SULFUR IN SELECTED PRODUCT COALS* (PSOC 282)

| Sample No. | Experiment[a] No. | Total Sulfur[b] wt % | Total Sulfur[b] % Removed | Pyritic Sulfur[b] wt % | Pyritic Sulfur[b] % Removed | Sulfate Sulfur[b] wt % | Sulfate Sulfur[b] % Removed | Organic Sulfur[b,c] wt % | Organic Sulfur[b,c] % Removed |
|---|---|---|---|---|---|---|---|---|---|
| 7 | 0060 | 0.51 | 66.9 | 0.02 | 95.4 | <0.05 | 86.1 | 0.49 | 34.7 |

*Analyses carried out at CSMRI
[a]For experimental details refer to Table II
[b]As determined basis
[c]By difference
[d]Coal pretreated with 1 M $Na_2CO_3$ solution
[e]Mixture of $N_2/Cl_2$ (4:1) during chlorination
[f]Chlorination only Pyritic sulfur reductions were uniformly above 90% except it was 48% in the case where the coal was only chlorinated. Sulfate sulfur reductions were also high. Organic sulfur reductions varied from 21–34% except in 2 cases where there was an apparent increase. In samples from experiments 0017 and 0039 (where the coals were not subjected to any post or intermediate washing treatments), the pyritic sulfur was reduced by 90%. Thus it appears that the sulfur is removed as gas-phase species and lends support to the proposed mechanism. This is also evident from experiment 0055 where the coal was only chlorinated resulted in 49% pyritic sulfur reduction. Consequently, in the proposed process, an intermediate wash between chlorination and dechlorination and/or hydrodesulfurization steps appears to be totally unnecessary, thereby simplifying the process considerably.

Four samples from typical experiments on PSOC 276 coal were analysed for total sulfur and sulfur forms. The results are presented in Table 6.

TABLE 6

TOTAL SULFUR AND FORMS OF SULFUR IN SELECTED PRODUCT COALS* (PSOC 276)

| Sample No. | Experiment[a] No. | Total Sulfur[b] wt % | Total Sulfur[b] % Removed | Pyritic Sulfur[b] wt % | Pyritic Sulfur[b] % Removed | Sulfate Sulfur[b] wt % | Sulfate Sulfur[b] % Removed | Organic Sulfur[b,c] wt % | Organic Sulfur[b,c] % Removed |
|---|---|---|---|---|---|---|---|---|---|
| — | Raw Coal | 3.87 | — | 2.63 | — | 0.06 | — | 1.17 | — |
| 4 | 0045 | 0.70 | 81.9 | 0.03 | 98.9 | <0.05 | — | 0.67 | 42.7 |
| 8 | 0064[d] | 2.81 | 27.4 | 0.72 | 72.6 | 1.02[f] | — | 1.07 | 8.5 |
| 9 | 0067 | 2.29 | 40.8 | 0.13 | 95.0 | <0.05 | — | 2.16[f] | — |
| 10 | 0069[l] | 1.73 | 55.3 | 0.04 | 98.5 | <0.05 | — | 1.69f | — |

*Analyses carried out at CSMRI
[a]For experimental details refer to Table 12
[b]As determined basis
[c]By difference
[d]Chlorination only
[e]5 min. chlorination and 10 min. dechlorination and hydrodesulfurization
[f]Anamolous results showing a substantial increase In experiment 0045 where maximum desulfurization of 82% was achieved the reductions in pyritic, sulfate and organic sulfur were 99%, 100% and 43%, respectively.

In experiments 0064, 0067 and 0069 the coal was chlorinated for 5 min. and dechlorinated/hydrodesulfurized for 10 min. It can be seen that simple chlorination for as short a time a 5 min. removes as high as 73% pyritic sulfur. Once again results of these experiments where the coals were not subjected to any washing treatment lend support to the contention that the sulfur is removed in the gas-phase and no intermediate washing step is necessary.

PSOC 276 coal is desulfurized to a greater extent compared to PSOC 282 coal. Even 5 min. chlorination followed by 10 min. dechlorination has resulted in 99% reduction in pyritic sulfur.

Four samples of chlorinated coals and, chlorinated and desulfurized coals were analyzed for long proximate and ultimate analyses. The results are presented in Table 7.

Promimate and ultimate analyses of PSOC 282 raw coal, coal chlorinated at 100° C. for 15 min. and chlorinated coal hydrodesulfurized at 700° C. for 30 min. are presented in Table 7.

TABLE 7

PROXIMATE AND ULTIMATE ANALYSES OF SELECTED PRODUCT COALS*

| Coal | Sample No. | Experiment No.[a] | Moisture[b] % | Ash % AD[b] | Ash % Dry[c] | Volatile Matter % AD | Volatile Matter % Dry | Fixed Carbon % AD | Fixed Carbon % Dry | Heating Value Btu/lb AD | Heating Value Btu/lb Dry | Carbon % AD | Carbon % Dry |
|---|---|---|---|---|---|---|---|---|---|---|---|---|---|
| PSOC 282 | 0 | Raw[e] Coal | 3.1 | — | 6.70 | — | 33.80 | — | 59.50 | — | 13,092 | — | 74.8 |
| " | A | 0055 | 3.61 | 5.88 | 6.10 | 34.50 | 35.80 | 56.00 | 58.10 | 10,752 | 11,150 | 62.40 | 62.70 |
| " | B | 0060 | 2.13 | 6.78 | 6.93 | 5.77 | 5.90 | 85.30 | 87.20 | 13,372 | 13,666 | 84.00 | 85.80 |
| PSOC 276 | 0 | Raw Coal | 1.89 | — | 11.50 | — | 37.20 | — | 51.30 | — | 12,755 | — | 71.60 |
| " | C | 0064 | 2.73 | 10.40 | 10.70 | 35.30 | 36.30 | 51.60 | 53.00 | 11,165 | 11,478 | 63.60 | 65.40 |
| " | D | 0069 | 1.31 | 12.80 | 13.00 | 7.09 | 7.18 | 78.80 | 79.80 | 12,580 | 12,744 | 79.10 | 80.10 |

| Sample No. | Hydrogen % AD | Hydrogen % Dry | Sulfur % AD | Sulfur % Dry | Nitrogen % AD | Nitrogen % Dry | Chlorine % AD | Chlorine % Dry | Oxygen %[d] AD | Oxygen %[d] Dry |
|---|---|---|---|---|---|---|---|---|---|---|
| 0 | — | 4.82 | — | 1.60 | — | 1.69 | — | 0.47 | — | 10.00 |

TABLE 7-continued

PROXIMATE AND ULTIMATE ANALYSES OF SELECTED PRODUCT COALS*

| | | | | | | | | | | |
|---|---|---|---|---|---|---|---|---|---|---|
| A | 4.22 | 3.96 | 1.16 | 1.20 | 1.27 | 1.32 | 12.40 | 12.90 | 12.70 | 9.82 |
| B | 2.20 | 2.00 | 0.48 | 0.49 | 1.60 | 1.64 | 0.50 | 0.51 | 4.44 | 2.63 |
| 0 | — | 5.67 | — | 3.91 | — | 1.28 | — | 0.16 | — | 5.87 |
| C | 4.70 | 4.52 | 2.84 | 2.92 | 1.11 | 1.14 | 4.43 | 4.55 | 12.90 | 10.80 |
| D | 2.21 | 2.09 | 1.63 | 1.65 | 1.38 | 1.40 | 0.13 | 0.13 | 2.75 | 1.63 |

*Analyses carried out at CSMRI
[a]For experimental details refer to Tables 11 and 12
[b]As determined basis
[c]Dry basis
[d]By difference By chlorination only the ash, carbon, hydrogen, sulfur and nitrogen contents slightly decrease while the oxygen content remained unchanged. There was a significant drop in heating value and substantial increase in chlorine content (12.9% compared to 0.47% in raw coal).

Dechlorination-cum-hydrodesulfurization resulted in a slight increase in the ash content and heating values. The volatiles decreased considerably (from 33.8% in raw coal to 5.9%), fixed carbon value increased substantially (87.2% compared to 59.5% in raw coal), carbon content increased from 74.8% to 85.8%, hydrogen content decreased from 4.8% to 2%, and nitrogen content remained almost unchanged. Hydrogen treatment resulted in a substantial decrease in the sulfur content (1.6% to 0.49%) and oxygen content (10% to 2.63%). The chlorine content after the dechlorination-cum-hydrodesulfurization treatment was almost the same as in the raw coal.

Overall, as a result of the desulfurization process there is a net increase in the ash content and heating values, a substantial increase in fixed carbon and carbon values, and a significant decrease in the volatile matter, hydrogen, sulfur and oxygen contents. Nitrogen and chlorine values remained more or less unchanged.

Considering PSOC 276 and as a consequence of chlorination, there was an initial decrease in ash content, heating value, carbon and nitrogen. The chlorine content increased substantially (from 0.16%–4.55%). After dechlorination and hydrodesulfurization, there was a net increase in the ash content (11.5–13.0%), fixed carbon (51.3–78.8%), carbon (71.6–80.1%) and nitrogen (1.28–1.4%). The increase in nitrogen content in this case may be due to successive dechlorination and hydrodesulfurization instead of dechlorination-cum-hydrodesulfurization as in the case of PSOC 282 coal. The volatile matter decreased from 37.2% to 7.2%, hydrogen decreased from 5.67–2.1%, sulfur decreased from 3.91% to 1.63% and oxygen decreased from 5.87% to 1.63%. The heating value and chlorine content remained more or less unchanged. In fact, the chlorine content of the desulfurized coal is even slightly lower than the raw coal.

In general, the desulfurization treatments resulted in a net increase in ash content and heating values, a substantial increase in fixed carbon and carbon values and an equally substantial reduction in volatile matter, hydrogen, sulfur and oxygen contents.

The results show that further reductions are possible in chlorine requirement in the process and that the use of chlorine in the process has not resulted in any increased chlorine levels in the product coals. This is significant because of environmental implications and corrosion considerations. The results also indicate that an intermediate wash to chlorinated coals may be totally unnecessary thereby making the process much more simple and economical.

It can be seen from the data that total sulfur reductions ranging from 35–80% can be achieved depending on the experimental conditions and coal type. These results amply validate the claim that a fluidized bed reactor process using chlorine may provide an efficient, simple and low cost method for coal desulfurization.

Although the present process may appear in some respects similar to the liquid chlorinolysis process, it is substantially different in its basic chemistry of chlorine-sulfur reactions for coal desulfurization and represents a significant advancement in technology over the chlorinolysis process. Chlorine gas readily reacts with sulfur compounds forming chlorine-sulfur compounds in the gas phase which decompose on contact with water and undergo further reactions. Thus, by reacting dry coal with chlorine, the coal sulfur can be removed as gas phase species which is in sharp contrast to the aqueous phase process where the sulfur is converted to sulfuric acid. The fluidizing gas provides an efficient means of dissipating the exothermic heat of chlorine reaction with sulfur. Wide flexibility in operation is provided by use of gas media and the gas media is much easier to handle and separate from the coal particles. A fluidized bed reactor is an ideal apparatus for reacting coal in the solid phase. The gas phase reaction products are easier to render environmentally safe than the wash liquids of the liquid chlorinolysis processes.

It is to be realized that only preferred embodiments of the invention have been described and that numerous substitutions, modifications and alterations are permissible without departing from the spirit and scope of the invention as defined in the following claims.

We claim:

1. A method of desulfurizing a particulate, carbonaceous material containing at least 0.2 percent by weight of sulfur comprising the steps of:

continuously suspending particles of the carbonaceous material in a common reactor vessel;

introducing an upwardly flowing column of chlorine gas at a temperature from 20° C. to 300° C. into the reactor vessel and chlorinating the material by suspending particles of the material in the upwardly flowing column of chlorine gas to form a fluidized bed and reacting chlorine with the material until at least 1 percent by weight of chlorine is added to the material; and exchanging the chlorine gas with an inert gas at a temperature of at least 300° C. and dechlorinating the material by suspending the material in said inert gas until the chlorine content of the material is reduced below 1 percent by weight.

2. A method according to claim 1 in which the material at least 0.2% by weight of sulfur and is selected from coal, petroleum, bitumens, oil shale, industrial waste, municipal waste, tars or black liquor residues.

3. A method according to claim 2 in which the coal is selected from bituminous, sub-bituminous or lignite coals.

4. A method according to claim 1 in which the chlorine gas is diluted with up to 90% by volume of an inert gas.

5. A method according to claim 4 in which the inert gas is nitrogen.

6. A method according to claim 4 in which the coal is presuspended in hot inert gas.

7. A method according to claim 3 further including the step of suspending the dechlorinated coal in hydrogen gas and removing further sulfur therefrom by hydrodesulfurization.

8. A method according to claim 7 in which the hydrogen gas is at a temperature of from 500° C. to 700° C.

9. A method according to claim 3 further including the step of washing and drying the coal before chlorinolysis.

10. A method according to claim 7 further including the step of washing and drying the coal after hydrodesulfurization.

11. A method according to claim 7 in which the coal is continuously suspended in a common reactor vessel by exchanging chlorine gas with inert gas and then with hydrogen gas.

* * * * *